United States Patent [19]

Heymanns

[11] 4,415,128

[45] Nov. 15, 1983

[54] RIDER ROLLS IN SUPPORT-ROLL WINDING MACHINES

[75] Inventor: Willi Heymanns, Kaarst, Fed. Rep. of Germany

[73] Assignee: Jagenberg Werke AG, Dusseldorf, Fed. Rep. of Germany

[21] Appl. No.: 299,269

[22] Filed: Sep. 3, 1981

[30] Foreign Application Priority Data

Sep. 20, 1980 [DE] Fed. Rep. of Germany ..... 3035652

[51] Int. Cl.[3] ..... B65H 17/08; B65H 17/12

[52] U.S. Cl. ..... 242/66

[58] Field of Search ..... 242/66, 65, 67.1 R, 242/67.2, 67.3, 67.4, 67.5

[56] References Cited

U.S. PATENT DOCUMENTS 2,276,980 3/1942 Jacobi ..... 242/66 X 3,837,593 9/1974 Dorfel ..... 242/66

3,990,648 11/1976 Justus ..... 242/66

4,180,216 12/1979 Dahl ..... 242/66

*Primary Examiner*—Stuart S. Levy

*Assistant Examiner*—Lloyd D. Doigan

*Attorney, Agent, or Firm*—Sprung, Horn, Kramer & Woods

[57] ABSTRACT

In an apparatus for winding a web on a roll 7 supported by two driver rolls 1,2 and including a rider roll 8 bearing on the top of the web roll and mounted for vertical displacement in lateral guides 17, the improvement which comprises two further rider rolls 9 mounted on either side of the web roll and with their axes parallel thereto so that they make contact with the circumference of the web roll only after the latter has attained a predetermined diameter. A corresponding process is described.

2 Claims, 4 Drawing Figures

RIDER ROLLS IN SUPPORT-ROLL WINDING MACHINES

BACKGROUND OF THE INVENTION

The invention relates to rider rolls which, bearing on the web roll, are mounted to be vertically displaceable in lateral guides of support-roll winding machines.

In support-roll winding machines, which as a rule are provided with two support rolls for the shaftless winding up of webs, the web roll sometimes runs jerkily and in extreme cases is even thrown out. This will happen when the web roll building up gets out of round due to poor paper quality, for example, and the rider roll which bears on it starts to jump.

To prevent damage by a web roll that is being thrown out of the winding machine, the winding machine has up to now been provided on both sides with flaps made of heavy plate, for safety reasons. However, these flaps are a nuisance in operation and mounting them is troublesome.

SUMMARY OF THE INVENTION

Thus there is a need to find a better way of providing protection against unintentional ejection of the web roll from the gap between the support rolls.

To fill this need, it is proposed, in accordance with the invention, to use a rider roll system comprising a first rider roll which bears on the web roll, and second and third further rider rolls mounted on either side of the web roll and with their axes parallel thereto so that they make contact with the circumference of the web roll only after the latter has attained a predetermined diameter.

At the start and during the initial phase of the winding operation, only one rider roll bears on the web roll, with their axes parallel, along the uppermost generatrix of the web roll, as heretofore. During this phase, the web roll still lies securely in the gap between the support rolls, and any out-of-roundness has no adverse effect.

However, as soon as the web roll attains a predetermined diameter, which can differ from case to case but may be about 50 cm, two further rider rolls, which are preferably mounted along with the first rider roll on a crossbeam that is laterally guided in the vertical direction, make contact with the web roll. These two further rider rolls are advantageously disposed symmetrically to the first rider roll, and their axes may be spaced apart by the same distance as those of the support rolls.

To deploy at first only one rider roll and in a subsequent phase of the winding operation also the two further rider rolls, it is of considerable importance, in accordance with the invention, that the first rider roll be displaceable by a motor relative to the crossbeam on which all rider rolls are mounted, and that the two further rider rolls be rigidly mounted by the use of bearing brackets. During the initial phase of the winding operation, the first rider roll then moves vertically upward, not at the same speed as the crossbeam but at an independent rate due to a motor drive. This separate drive for the first rider roll is adapted to be turned off when the two further rider rolls make contact with the web roll so that the web roll is engaged by all three rider rolls. However, since two-point bearing pressure is always better than three-point bearing pressure, it is preferred, in accordance with the invention, that the first rider roll be displaced by its separate drive, preferably a worm drive, an additional distance until it is out of contact with the web roll, the latter then being engaged only by the two further rider rolls.

The procedure followed in the operation of the rider roll arrangement in accordance with the invention is preferably such that at the start of the winding operation only the first, middle rider roll is in contact with the web roll and, while the latter is building up, moves vertically upward at a faster rate than the crossbeam on which it is mounted for displacement relative thereto, and that when the web roll attains a predetermined diameter of about 50 cm, for example, the two further rider rolls make contact with the web roll, the first rider roll then being optionally lifted off the web roll.

Since the two outer rider rolls make contact with the web roll at a lower level, the latter is held much better on both sides along its length than it is by a rider roll bearing on its top. This becomes more and more important as the diameter of the web roll increases, and with it the risk that the web roll may be thrown out of the winding machine because of out-of-roundness.

Apart from the rider-roll arrangement described above, in which the first rider roll is displaced relative to the common crossbeam and the two further rider rolls are rigidly mounted on said crossbeam, alternatives with movable, and more particularly with pivotable and slideable, rider rolls are conceivable, and while these can readily be implemented, they are of greater complexity than the embodiment referred to above as preferred.

BRIEF DESCRIPTION OF THE DRAWINGS

The invention will now be described in greater detail with reference to the accompanying diagrammatic drawings, wherein FIG. 1 is a side elevation showing the rider rolls in a first position, while FIG. 2 shows them in a further position and FIG. 3 shows them in a third position, FIG. 4 being a fragmentary view of the lateral guide of the crossbeam.

DETAILED DESCRIPTION OF THE INVENTION

Figures 1, 2, 3, 4:
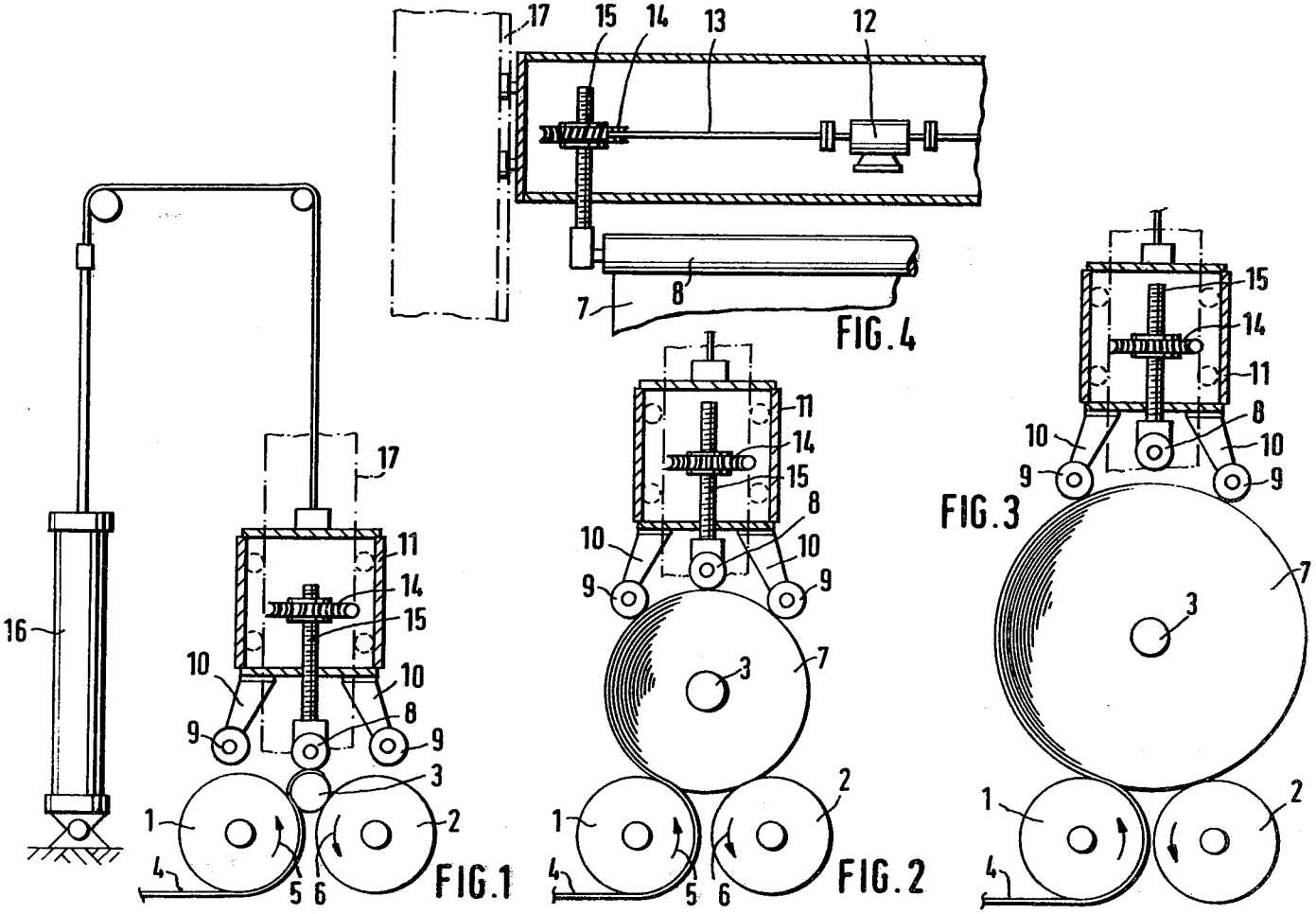

The shaftless winding machine essentially consists of axially parallel support rolls 1 and 2, at least one of which is driven in rotation. A core tube 3 is placed in the gap between the support rolls 1 and 2, and the leading end of a web 4 is attached to the core tube 3. The support rolls 1 and 2 are then caused to rotate in the directions indicated by the arrows 5 and 6, with the core tube 3 then also rotating and the web 4 being wound onto it, to form a web roll 7 on the tube 3.

FIG. 1 illustrates a condition in which the diameter of the web roll 7 has already increased and a middle rider roll 8 still bears on the top of the web roll 7. Two further rider rolls 9 which symmetrically flank the first rider roll 8 and which like the latter are mounted on the crossbeam 11, though by means of rigid bearing brackets 10, are not as yet in contact with the surface of the web roll 7.

Through a worm drive motor 12 and worm drive members 13, 14 and 15 (FIG. 4), displacement of the rider roll 8 relative to the crossbeam 11 can be effected. Through this relative motion, the rider roll 8 is raised at a faster rate than the crossbeam 11, which is automatically pushed vertically upward by the increasing diameter of the web roll 7. The pneumatic or hydraulic piston/cylinder unit 16 serves to lighten the crossbeam 11, which is laterally guided in guides 17.

In the intermediate position shown in FIG. 2, in which the diameter of the web roll 7 has reached a predetermined size, the first rider roll 8 is nearly fully retracted while the further rider rolls 9 are in contact with the surface of the web roll 7 and thus secure the latter against being thrown sideways out of the gap between the support rolls 1 and 2. Since the rider rolls 9 now assume the function of the rider roll 8, the latter can be retracted into an inactive position, as shown in FIG. 3, while the rider rolls 9 remain in contact with the web roll 7 until the winding operation has been completed.

It will be appreciated that the instant specification and claims are set forth by way of illustration and not of limitation, and that various changes and modifications may be made without departing from the spirit and scope of the present invention.

I claim:

1. In an apparatus for winding a web on a roll supported by two driver rolls and including a rider roll bearing on the top of the web roll and mounted for vertical displacement in lateral guides, two further rider rolls symmetrically mounted on either side of the web roll and with their axes parallel thereto, and means for contacting the further rider rolls with the circumference of the web roll only after the latter has attained a predetermined diameter, all three rider rolls being mounted on a crossbeam which is vertically guided, the improvement wherein the first rider roll is mounted on the crossbeam for displacement relative thereto and the further rider rolls are mounted on the cross beam by means of rigid bearing brackets.

2. An apparatus according to claim 1, including a motor and worm members driven thereby operatively engaging the first rider roll so as to vertically displace said roll on the crossbeam.

* * * * *